United States Patent [19]

Szego

[11] 4,149,649

[45] Apr. 17, 1979

[54] EXPLOSION-SUPPRESSIVE MASSES

[75] Inventor: Andrew Szego, Toronto, Canada

[73] Assignee: Explosafe America Inc., Rexdale, Canada

[21] Appl. No.: 818,581

[22] Filed: Jul. 25, 1977

[30] Foreign Application Priority Data

Jul. 28, 1976 [GB] United Kingdom ..... 31427/76

[51] Int. Cl.[2] ..... B65D 87/48

[52] U.S. Cl. ..... 220/88 A; 29/400 R; 29/400 M; 29/400 D; 29/412; 29/414; 29/428; 169/66; 244/135 R; 428/588; 428/589; 428/592; 428/593

[58] Field of Search ..... 428/593, 596, 597, 592, 428/588, 589; 29/400 R, 400 M, 400 D, 412, 414, 428; 220/88 R, 88 A; 244/135; 169/66

[56] References Cited

U.S. PATENT DOCUMENTS

| | | | |
|---|---|---|---|
| 1,134,838 | 4/1915 | Gaumer | 220/88 A |
| 2,805,083 | 9/1958 | Frost | 220/88 R |
| 3,017,971 | 1/1962 | Christman | 428/593 X |
| 3,086,624 | 4/1963 | Wyatt | 428/596 |
| 3,356,256 | 12/1967 | Szego | 220/88 A |
| 4,013,190 | 3/1977 | Wiggins et al. | 220/88 R X |

FOREIGN PATENT DOCUMENTS

| | | | |
|---|---|---|---|
| 705745 | 3/1965 | Canada | 220/88 A |
| 736802 | 6/1966 | Canada | 220/88 A |

*Primary Examiner*—Richard E. Schafer
*Attorney, Agent, or Firm*—Ridout & Maybee

[57] ABSTRACT

An explosive-suppressive mass comprises layers of expanded metal of which each layer is arranged in a selected orientation so that its mesh strands are inclined with respect to the mesh strands of the layers adjacent thereto. This gives economic and other advantages in the manufacture of the anti-explosive materials.

10 Claims, 5 Drawing Figures

EXPLOSION-SUPPRESSIVE MASSES

BACKGROUND OF THE INVENTION

The present invention relates to the production of filler masses for use as explosive-suppressive fillings in containers for fuels and other explosive fluids.

U.S. Pat. No. 3,356,256 dated Dec. 5, 1967 in the name Joseph Szego describes filler masses formed of layers of metal netting, the netting being composed of interconnected metal ribbons which are misaligned with the general plane of the netting. Such netting can be produced by metal-expanding procedures, employing metal expander machines of the reciprocating type, or of the rotary type. Both types of machine can produce expanded metal which has diamond-shaped mesh openings and is composed of interconnected flat mesh strands which incline at the same angle relative to the general plane of the metal.

SUMMARY OF THE INVENTION

Applicant has found that the filler masses formed of multiple layers of expanded metal are often of unduly high bulk density. In particular when, in the course of an economical manufacturing method, coiled bales are formed by coiling expanded aluminum foil of the mesh and strand dimensions specified in the above-mentioned patent, the bales obtained typically have a bulk density somewhat in excess of the value of 52.4 kilogram per cubic meter which is recommended in the above patent. It is desirable that the bulk density should be kept low so as to minimize the cost of the filling, and the weight that it adds, as well as the reduction in capacity that results when the bale is fitted into a gas tank.

Further, the filler masses tend to be of uncontrolled variable density as they are susceptible to compaction under pressure, so that the eventual bulk density may tend to vary as a result of pressures applied to the mass during manufacture or in subsequent handling or in the course of placing and positioning the masses within the fuel or other containers.

In accordance with the invention, filler masses which have stabilised reduced bulk densities, can be obtained by arranging the successive layers of expanded metal in such fashion that the inclining mesh strands in each layer are directed oppositely to the mesh strands in the adjacent layers. Whereas if similar layers of expanded metal are laid directly one on top of another with the edges of the successive layers in register, the layers tend to nest closely together, to a degree dependent on the pressures applied to the masses, when the layers are arranged so that the mesh strands in adjacent layers are oppositely directed, the oppositely inclining mesh strands engage together in such manner that the layers are more widely spaced, giving a more springy, resilient filler mass of reduced bulk density, which does not tend to become permanently compacted.

Further, applicant has found that in the process of composing or compiling the expanded metal layers together into a multiple layer mass, the successive layers may become slightly displaced one from another in the same transverse direction as a result of the nesting mentioned above, with the result that the completed filler mass has sloped end faces. For example, where rotary slit expanded metal is reeled up lengthwise to form a coiled bale, the successive turns of metal become displaced transversely in the direction of the coil axis, so that the coiled bale has a coned projecting face at one end and a cone-shaped recess at the other.

The usual fuel containers typically have flat walls, at least at the top and bottom, and to give satisfactory explosion-suppressive protection it is required that the filler masses should substantially completely fill the interior of the container without leaving empty voids in which an explosion may occur. It will be appreciated, therefore, that filler masses having coned or other sloped ends cannot satisfactorily be used directly as fillings for the containers without mismatching resulting between the profile of the filler mass and of the interior of the container, leaving unprotected voids between the container walls and the filler mass.

The present invention provides a method of forming a filler mass composed of multiple layers of expanded metal having flat mesh strands inclined at the same angle to the general planes of the layers, in which the successive layers are arranged so that the strands in each layer are oppositely inclined to the strands in the adjacent layers.

The invention also provides a filler mass composed of multiple layers of expanded metal having mesh strands inclined at the same angle to the general planes of the layers, in which the strands in each layer are oppositely inclined to the strands in the adjacent layers.

Where the filler mass is formed as a coiled bale by reeling up a web of the expanded metal, the desired arrangement of the layers can be obtained by interleaving the feed of the metal with an auxiliary web of expanded metal from an auxiliary supply, the metal of the auxiliary web having its strands oppositely inclined to the strands in the main web.

The auxiliary web may be provided from a previously wound coil of the expanded metal which is then turned end over end before feeding from the coil in overlying relationship with the main web of expanded metal.

The desired orientation of the mesh strands can also be obtained by fan-folding a web of the expanded metal along fold lines extending parallel to the direction in which the mesh strands are inclined, that is to say transversely of the web in the case of rotary slit material, or longitudinally of the web in the case of expanded metal supplied from a reciprocating type expander machine. A similar result can be achieved by severing the web of expanded metal into uniform pieces, and inverting alternate pieces or turning them in their plane so as to give the desired mesh strand orientation before stacking the pieces one on the other to form a multiple layer mass.

BRIEF DESCRIPTION OF THE DRAWINGS

Methods in accordance with the present invention will now be described in greater detail, by way of example only, with reference to the accompanying drawings in which: only, with reference to the accompanying drawings in which.

DESCRIPTION OF THE PREFERRED EMBODIMENTS

Figure 1:
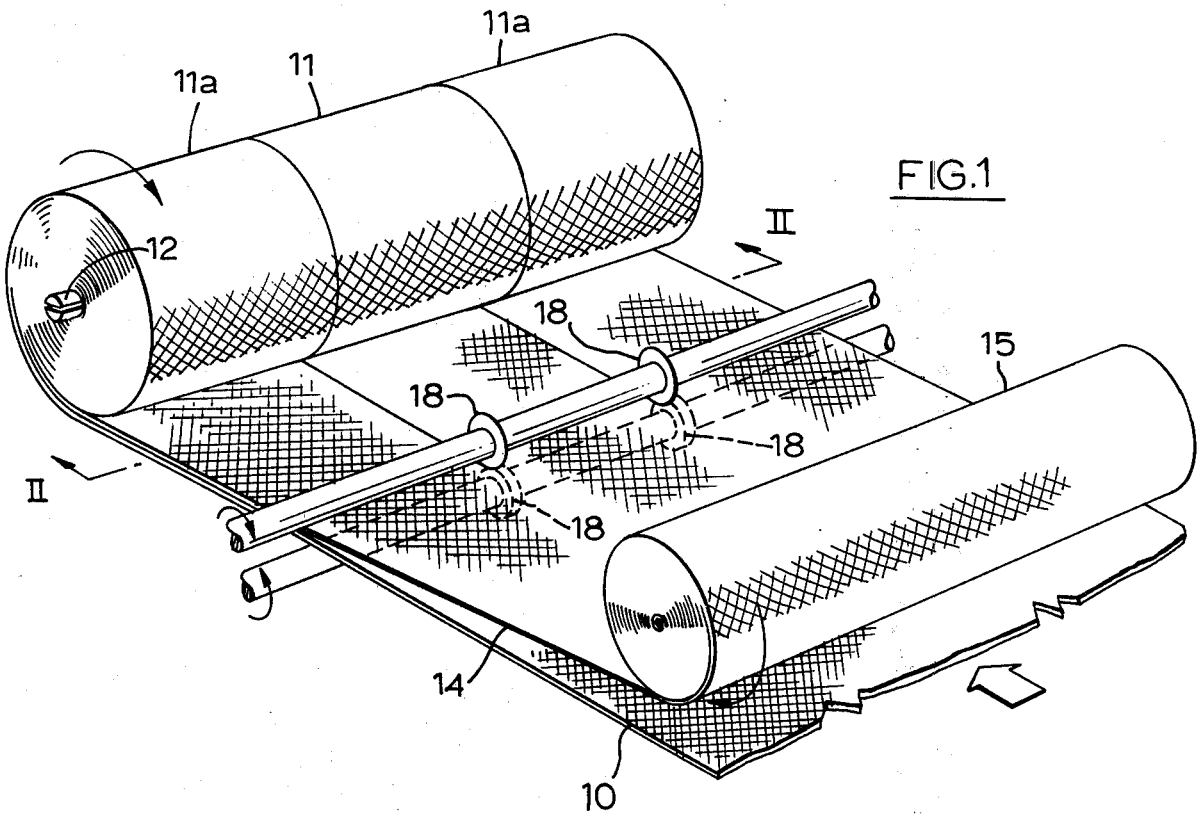
FIG. 1 illustrates a method for forming expanded metal into a coiled bale.
Figure 2:
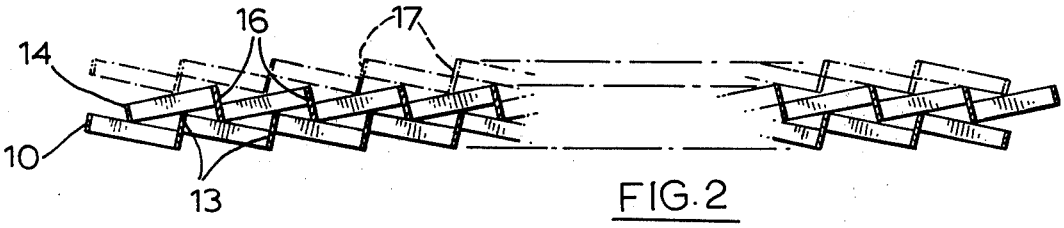
FIG. 2 shows a cross-section on the line II—II of FIG. 1.

Referring to FIG. 1, this shows a web 10 of expanded metal supplied from an expander machine which expands rotary slit metal. The web 10 is reeled into a coiled bale 11 on a spindle 12. As can be seen in FIG. 2, the web 10 is composed of interconnected flat metal strands 13 which are inclined transversely at the same angle to the general plane of the web 10. These inclined mesh strands bound and define the edges of diamond-shaped mesh openings in the expanded metal.

A secondary web 14 of similar expanded metal mesh is interleaved with the main web 10 as it is wound on the spindle 11. The secondary web 14 is supplied from a precoiled auxiliary supply reel 15 rotatably supported above the main web 10. As can be seen in FIG. 2 the mesh of the secondary web 14 is orientated so that its mesh strands 16 are inclined transversely oppositely with respect to the strands 13 of the main web 10.

Hence, in the completed bale 11, the strands of adjacent layers of mesh are transversely oppositely inclined, as illustrated in FIG. 2, where there is shown in broken lines the orientation of the strands 17 constituting the next turn of the main web 10 of mesh on the bale.

The auxiliary supply reel 15 may be pre-wound from the main web 10 from the expander machine, the reel obtained then being turned end over end so that when the secondary web 14 is uncoiled from it, it will present itself with its mesh strands 16 oppositely inclined to those of the main web.

Alternatively, two separate expander machines operating on rotary slit metal could be used, one supplying the main web 10, and the other the secondary web 14, with the expander arms of one machine being counter-inclined as compared with the other machine so as to provide output meshes with mutually oppositely inclining strands.

As shown in FIG. 1, the superimposed webs 10 and 14 may be severed longitudinally before being wound up, employing upper and lower sets of co-operating, counter-rotating cutter discs 18, so as to provide coiled-up segments 11*a* of shorter length for matching the interior dimensions of fuel or other containers into which the segments are to be fitted as explosion-suppressive fillings.

If, contrary to the invention, the interleaving of the secondary web 14 is omitted, and successive turns of the main web 10 are laid directly one on another, the expanded metal layers tend to become nested closely together, with the faces of the mesh strands in close alignment. This leads to a greater bulk density for the completed filler mass. Further, even though the successive layers are laid with their edges initially in register, the layers become displaced transversely over one another as a result of the nesting of the inclining mesh, resulting in the coiled bale having a coned face at one end and a coned recess at the other. As can be seen from FIG. 2, the interleaving of the secondary web 14 increases the effective spacing between the layers of expanded metal, and there is no tendency for the layers to nest together. Employing the interleaving procedure described above, there is obtained a coiled bale with a bulk density about two-thirds of that obtained when the interleaving is omitted.

Figure 3:
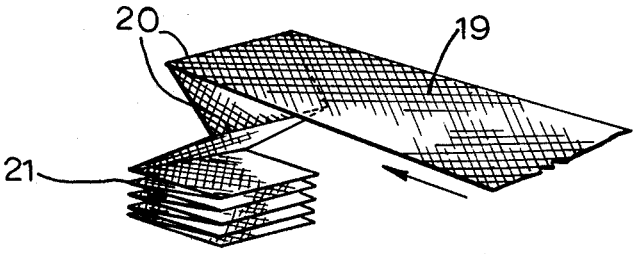
FIG. 3 illustrates a fan-folding method.

FIG. 3 illustrates fan-folding a continuous length 19 of expanded metal having its mesh strands inclining transversely of the direction of web, similar to the web 10 described above. The web 19 is folded along regularly spaced alternating transverse fold lines 20 to produce a multiple layer rectangular section mass 21. The alternate layers in the mass 21 are inverted with respect to one another as a result of the fan-folding, whereby the mesh strands in each layer are oppositely inclined with respect to the strands in the adjacent layers.

Figure 4:
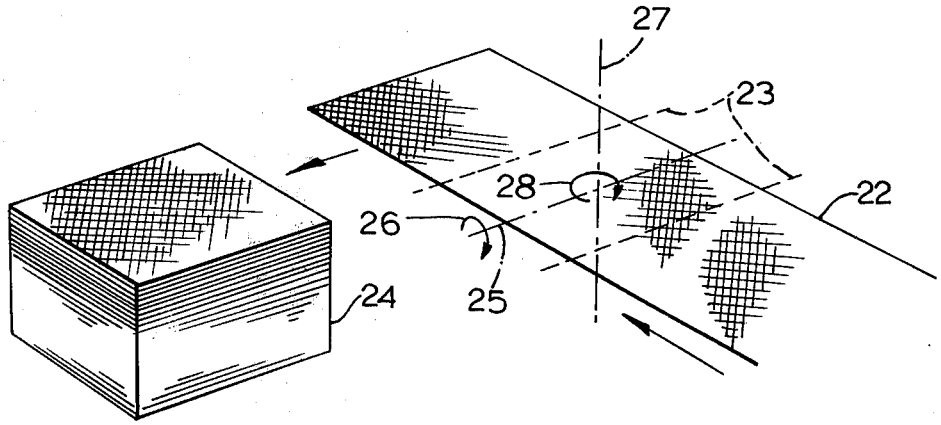
FIG. 4 illustrates a stacking method.

A further procedure is illustrated in FIG. 4, where a web of expanded metal 22, again with its mesh strands inclining transversely of the direction of web, similar to the web 10 described above in connection with FIG. 1, is severed into uniform lengths along transverse lines of cut 23, and the rectangular sections thus obtained are stacked one on top of the other to form a rectangular mass 24. Every other section is turned about so that its mesh strands incline oppositely with respect to the strands of the preceding section in the mass 24. In order to obtain the desired orientation of the mesh strands, the said alternate sections are rotated through 180°, either by inverting them about the transverse axis 25, as indicated by the arrow 26, or by turning them in their plane about the normal axis 27, as indicated by the arrow 28.

The detailed description above refers to expanded metal, such as rotary slit expanded metal, in which the mesh strands are inclined transversely of the web. When using expanded metal in which the mesh strands are inclined longitudinally of the web, e.g. reciprocating-cut metal as obtained from reciprocating metal-expanding machines, multiple-layer masses having the strands in adjacent layers oppositely inclined can be obtained by using the appropriate orientation of the successive layers.

The interleaving method described above with reference to FIGS. 1 and 2 may be used, or the method of severing the web into sections and rotating alternate sections through 180° in their plane as described above with reference to the arrow 28 in FIG. 4. Longitudinal fan-folding as shown in FIG. 3 cannot, however, be used, nor can the method of rotating alternate severed sections about their transverse axes, as indicated by the arrow 26 in FIG. 4, since these methods leave the strands of adjacent layers inclined parallel to one another. With a web of suitably large width, a mass with the desired opposite inclination of strands can be obtained by severing the web transversely and then fan-folding the severed sections along fold lines extending longitudinally of the original web.

A further procedure would be to employ a method generally similar to that described with reference to FIG. 4, but to invert alternate sections by turning them through 180° about axes extending longitudinally of the web feed.

By arranging the layers of expanded metal so that the mesh strands in adjacent layers of oppositely inclined, the interengagement of the oppositely inclining strands stabilizes the mass against lateral slippage of the layers, which could lead to the mass becoming distorted in shape either during the manufacturing procedure or subsequently. This interengagement also prevents the layers from nesting closely together and serves to space the material of adjacent layers further apart. Thus, the overall density is reduced as compared with masses in which all the mesh strands are inclined parallel to one another, and this can give a significant reduction in the weight of material which is required to fill a container of given volume.

The filler masses which are obtained can be used directly as fillers for the interiors of fuel containers or other containers for inflammable or explosive fluids, or may be trimmed to an appropriate size or shape for matching the interiors of the containers.

The coiled segments 11*a* shown in FIG. 1 may, for example, be used directly as fillers for conventional cylindrical fuel cans e.g. gasoline cans.

Figure 5:
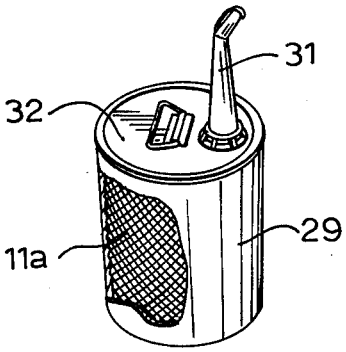
FIG. 5 shows a fuel container having an explosion-suppressive filling.

FIG. 5 shows a metal gasoline can body 29 in the form of a cylindrical container having a pouring opening equipped with a pouring spout 31. The interior of the body is filled with a coiled segment 11*a* of the expanded metal. In manufacture of the can, the segment 11*a* is inserted into the can prior to applying the lid 32 which closes the top of the container.

I claim:

1. A method of forming an explosion-suppressive mass comprising providing a lamina of expanded metal consisting of flat mesh strands defining diamond-shape mesh openings, the strands each being inclined at the same angle to the general plane of the lamina, and layering the lamina to form a multiple-layer mass, the strands of each layer being inclined oppositely to the strands in each adjacent layer.

2. A method as claimed in claim 1 wherein said layering comprises coiling the lamina into a cylindrical bale and including interleaving an auxiliary lamina with the first-mentioned lamina, the auxiliary lamina consisting of mesh strands inclining oppositely to the mesh strands of the first-mentioned lamina.

3. A method as claimed in claim 1 wherein the lamina is a continuous length of rotary slit expanded metal consisting of mesh strands inclined at the same angle with respect to the transverse direction, and wherein said layering comprises fan-folding the metal about transverse fold lines.

4. A method as claimed in claim 1 wherein the lamina is a continuous length of rotary slit expanded metal consisting of mesh strands inclined at the same angle with respect to the transverse direction and including the steps of severing said length transversely into sections and rotating each alternate severed section about its transverse axis prior to stacking the sections one on another.

5. A method as claimed in claim 1 wherein the lamina is a continuous length of an expanded metal material selected from rotary slit expanded metal consisting of mesh strands inclined at the same angle to the transverse direction and reciprocating-cut expanded metal consisting of mesh strands inclined at the same angle to the longitudinal direction and including the steps of severing the length transversely into sections and rotating each alternate section through 180° in its own plane prior to stacking the sections one on top of another.

6. An explosion-suppressive mass comprising multiple layers of expanded metal, said expanded metal consisting of flat mesh strands defining diamond-shaped mesh openings, the strands each being inclined at the same angle to the general plane of the expanded metal, the strands in each layer being inclined oppositely to the strands in each adjacent layer.

7. A mass as claimed in claim 6 constituted by at least two interleaved expanded metal layers coiled into a cylindrical bale.

8. A mass as claimed in claim 6 comprising discrete expanded metal pieces of similar shape stacked one on top of another.

9. A container for explosive fluids equipped internally with an expanded metal mass consisting substantially wholly of layers of expanded metal consisting of flat mesh strands defining diamond-shaped openings, each strand being inclined at the same angle to the general plane of the metal, and the strands of each layer being inclined oppositely to the strands in each adjacent layer.

10. A cylindrical container for explosive fluids equipped internally with a cylindrical bale comprising a cylindrically-coiled winding having a plurality of turns of two superimposed laminae of expanded metal, each lamina being constituted by flat mesh strands defining diamond-shaped mesh openings and each strand being inclined at the same angle to the general plane of the lamina, and wherein the strands in each turn of one lamina incline oppositely to the strands of each adjacent turn of the other lamina.

* * * * *